US006330907B1

(12) United States Patent
Ogushi et al.

(10) Patent No.: US 6,330,907 B1
(45) **Date of Patent: *Dec. 18, 2001**

(54) EVAPORATOR AND LOOP-TYPE HEAT PIPE USING THE SAME

(75) Inventors: Tetsurou Ogushi; Masaaki Murakami; Akira Yao; Takeshi Okamoto; Hiromitsu Masumoto; Hisaaki Yamakage, all of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/393,682

(22) Filed: Sep. 10, 1999

(51) Int. Cl.[7] ..... F28D 15/00
(52) U.S. Cl. ..... 165/104.26; 165/907
(58) Field of Search ..... 165/104.33, 907, 165/104.26

(56) References Cited

U.S. PATENT DOCUMENTS

| | | | | |
|---|---|---|---|---|
| 3,745,972 | * | 7/1973 | Thettu | 117/17.5 |
| 3,857,441 | * | 12/1974 | Arcella | 165/104.26 |
| 4,023,617 | * | 5/1977 | Carlson et al. | 165/104.26 X |
| 4,118,756 | * | 10/1978 | Nelson et al. | 165/104.26 X |
| 4,207,027 | * | 6/1980 | Barry et al. | 165/104.26 |
| 4,576,009 | | 3/1986 | Ogushi et al. . | |
| 4,765,396 | | 8/1988 | Seidenberg . | |
| 5,259,447 | | 11/1993 | Ogushi et al. . | |
| 5,335,720 | | 8/1994 | Ogushi et al. . | |
| 5,732,317 | * | 3/1998 | Orchard, II et al. | 399/325 |
| 6,058,711 | * | 5/2000 | Maciaszek et al. | 165/104.26 |
| 6,241,008 | * | 6/2001 | Dunbar | 165/104.26 |

FOREIGN PATENT DOCUMENTS

| | | | | |
|---|---|---|---|---|
| 0823811 | * | 4/1981 | (SU) | 165/104.26 |
| 1038790 | * | 8/1983 | (SU) | 165/104.26 |
| 1467354 | * | 3/1989 | (SU) | 165/104.26 |

OTHER PUBLICATIONS

Stenger; "Experimental Feasibility Study of Water–Filled Capillary–Pumped Heat–Transfer Loops", Lewis Research Center, pp. 1–32.

Ogushi et al.; "Heat Transfer Performance of Flexible Looped Heat Pipe", 10$^{th}$ International Heat Pipe Conference, Sep. 21–25, 1997, Stuttgart, Germany.

* cited by examiner

*Primary Examiner*—Christopher Atkinson
(74) *Attorney, Agent, or Firm*—Leydig, Voit & Mayer, Ltd.

(57) ABSTRACT

An evaporator includes a container, a wick provided in contact with an inner peripheral surface of said container and formed such that (1) if the number of pores per unit volume is fixed, the diameter of pores is varied, or (2) if the diameters of pores are formed substantially uniformly, the number of pores is varied, a sump having said wick as its inner wall surface and connected to a liquid pipe for supplying a liquid-phase working fluid, and a vapor channel formed in a contact surface of said container with respect to said wick so as to guide a gas-phase working fluid into a vapor pipe connected to an end portion of said container.

10 Claims, 11 Drawing Sheets

EVAPORATOR AND LOOP-TYPE HEAT PIPE USING THE SAME

BACKGROUND OF THE INVENTION

1. Field of the Invention

The present invention relates to a loop-type heat pipe used as a heat conveying device for aerospace use, industrial use, and household use.

2. Description of the Related Art

FIG. 14 is an explanatory diagram illustrating the configuration of a conventional loop-type heat pipe disclosed in U.S. Pat. No. 4,765,396. FIG. 15 is a radial cross-sectional view illustrating the evaporator shown in FIG. 14. In the drawings, reference numeral 1 denotes an evaporator which is comprised of an evaporator container 3 having grooves and ridges 20 on its inner wall surface; a wick 2 provided in contact with the ridges 20; vapor channels 4 in the grooves between the wick 2 and adjacent ridges 20 of the evaporator 3; and a sump 5 surrounded by the wick 2 to accumulate a liquid-phase working fluid. Reference numeral 6 denotes a vapor pipe for introducing a gas-phase working fluid 10 into a condenser 7. Numeral 8 denotes a liquid pipe for recirculating the liquid-phase working fluid into the evaporator 1. Numeral 9 denotes an arrow indicating the flow of heat to be applied, 10 denotes an arrow indicating the flow of the gas-phase working fluid, 12 denotes an arrow indicating the flow of heat flowing out from the condenser 7, and 13 denotes an arrow indicating the flow of the working fluid which has been converted to the liquid phase after condensation of the gas-phase working fluid. As the wick 2, a polyethylene thermoplastic having uniform pores with a pore diameter of 10 to 12 mm in its entirety is used.

A description will be given of the operating principle of the conventional loop-type heat pipe constructed as described above. As shown by the arrow 9 indicating the flow of heat, the heat applied to the evaporator 1 is transmitted to the evaporator container 3 and causes the liquid-phase working fluid to evaporate in portions of contact 14 between the wick 2 and the ridges 20 of the evaporator container 3. The gas-phase working fluid 10 flows into the condenser 7 through the vapor channels 4 and the vapor pipe 6. As shown by the arrow 12 indicating the flow of heat flowing out from the condenser 7, the gas-phase working fluid which flowed into the condenser 7 is cooled, condenses, and is liquified and converted to a liquid-phase working fluid 15.

As shown by the arrow 13, the liquid-phase working fluid 15 passes through the liquid pipe 8 and is recirculates to the evaporator 1. The liquid-phase working fluid 15 which returned to the evaporator 1 is accumulated in the sump 5. The liquid-phase working fluid 15 is conveyed to the portions of contact 14 between the wick 2 and the ridges 20 of the evaporator container 3 by capillary action, and is vaporized and converted to a gas-phase working fluid by the heat absorbed by the evaporator 1.

In the above-described conventional loop-type heat pipe, if the volume of the sump 5 becomes large, the diameter of the sump 5 also becomes large. As shown by the arrow 16 in FIG. 14, the liquid-phase working fluid 15 accumulated in the bottom portion of the sump 5 permeates toward the upper portion of the wick 2 along the circumference of the wick 2, so that if the diameter of the sump 5 becomes large, the diameter of the wick 2 also becomes large. Hence, the liquid-phase working fluid has difficulty flowing toward an upper portion 17 of the evaporator container 3. There has been a problem in that if the rate of permeation of the liquid-phase working fluid into the wick 2 and the rate of evaporation from the wick 2 become off-balance, variations occur in the temperature distribution of the wick 2 and overheating proceeds locally, so that the heat conveying capacity which is obtained by a predetermined temperature difference between the evaporator 1 and the condenser 7 declines.

In addition, if the amount of heating of the evaporator 1 becomes large, the evaporation in the wick 2 proceeds before the liquid-phase working fluid 15 uniformly permeates the wick 2, and the working fluid, particularly in the upper portion of the wick 2, is completely evaporated. In that case, the gas-phase working fluid 10 in the vapor channels 4 flows backward from the wick 2 into the sump 5. As the result of the fact that the gas-phase working fluid which flowed backward through the wick 2 increases the pressure within the sump 5, the liquid-phase working fluid 15 condensed in the condenser 7 fails to be recirculated to the sump 5, thereby stopping the function of the overall loop-type heat pipe.

In addition, in the operation of this apparatus, the pressure within the vapor channels 4 becomes the highest, and the pressure within the sump 5 becomes the lowest. A capillary pressure difference ΔPc due to the wick 2, which serves as the driving force for liquid circulation, is produced between the vapor channels 4 and the sump 5, and a force due to this capillary pressure difference is constantly applied between the outer surface and inner surface of the wick 2. This capillary pressure difference ΔPc is expressed by the following formulae by using the pore diameter Rp of the wick and the surface tension s of the working fluid:

$$\Delta Pc = 2\sigma / Rp \tag{1}$$

As shown by this formula, the smaller the pore diameter Rp of the wick 2, the greater the capillary pressure difference ΔPc. That is, the smaller the pore diameter, the greater the force applied between the outer surface and inner surface of the wick 2, and this force causes the wick to be depressed toward its interior. As a result, there has been a problem in that contact at the portions of contact 14 between the outer surface of the wick 2 and the groove ridges 20 becomes incomplete, which hampers the smooth heat exchange of the liquid-phase working fluid 15 permeated in the wick 2.

Further, there has been a problem in that if the inside diameter of the sump 5 is made small to allow the liquid-phase working fluid 15 to uniformly permeate the overall wick, the internal volume of the sump 5 becomes small, making it impossible to accumulate the predetermined liquid-phase working fluid required.

In addition, unless portions of contact 18 between an end of the evaporator container 3 and the wick 2 are completely sealed, the gas-phase working fluid 10 which evaporated in the portions of contact 14 between the wick 2 and the ridges 20 of the evaporator container 3 flows backward from the portions of contact 18 into the sump 5, thereby increasing the pressure within the sump 5. As a result, there has been a problem in that the recirculation of the liquid-phase working fluid 15 condensed in the condenser 7 into the sump 5 is hampered, stopping the function of the loop-type heat pipe.

Further, there has been a problem in that if the liquid-phase working fluid 15 in the sump 5 evaporates by coming into contact with a contact surface 19 of the heated evaporator container 3, the pressure within the sump 5 rises, and the recirculation of the liquid-phase working fluid, which radiated heat and condensed in the condenser 7, into the sump 5 is hampered, thereby stopping the function of the loop-type heat pipe.

In addition, when heat enters only from one side of the evaporator container 3, if the evaporator container 3 has a hollow cylindrical shape, the evaporation of the liquid-phase working fluid in the wick is concentrated on one side, and the pressure loss in the wick becomes large, so that there has been the problem that the heat conveying capacity declines.

In addition, since the fabrication of the hollow cylindrical wick 2 is difficult, there has been a problem in that its fabrication cost is high.

In addition, the heat which was conducted from the evaporator container 3 to the sump 5 through the wick 2 heats and vaporizes the liquid-phase working fluid 15 in the sump 5, and produces the gas-phase working fluid in the sump 5. Since the temperature of the liquid-phase working fluid 15 which passed through the liquid pipe 8 and recirculated to the sump 5 is low, the gas-phase working fluid in the sump 5 undergoes heat exchange at its surface of contact with the liquid-phase working fluid 15 as well and is returned to the liquid-phase working fluid by undergoing a change in its phase. However, since the area of contact between the gas-phase working fluid in the sump 5 and the liquid-phase working fluid recirculated from the condenser 7 is limited to only the surface of the liquid-phase working fluid 15 in the sump 5, the efficiency in heat exchange is poor, and the pressure within the ll 5 rises. There has been a problem in that the rise in the pressure within the sump 5 hampers the circulation of the working fluid in its liquid phase or gas phase, possibly stopping the function of the loop-type heat pipe.

As shown in Formula (1), the smaller the pore diameter Rp of the wick 2, the greater capillary pressure difference $\Delta Pc$ can be obtained. In the conventional example, since a wick having a large pore diameter Rp of 10 to 12 $\mu$m is used, the capillary pressure difference $\Delta Pc$ becomes small, with the result that there has been a problem in that the heat conveying capacity becomes small.

In addition, since the heat conductivity of the wick 2 used in the conventional example is small, the heat absorbed by the evaporator container 3 is not conducted efficiently to the wick 2. There has been a problem in that, in that case, the efficiency in heat exchange between the evaporator container 3 and the wick 2 permeated by the liquid-phase working fluid 15 is low.

SUMMARY OF THE INVENTION

The present invention has been devised to overcome the above-described problems, and its object is to obtain a loop-type heat pipe which operates with a small temperature difference irrespective of the presence or absence of gravity and the relative magnitude of heat flux even in a case where a large-volume sump is provided.

The evaporator in accordance with the present invention comprises:

a container having grooves formed in its inner peripheral surface, a wick provided in contact with an inner peripheral surface of the container and formed in such a manner as to closely contact groove ridges on the container and such that (1) if the number of pores per unit volume is fixed, the diameter of pores is varied, or (2) if the diameters of pores are formed substantially uniformly, the number of pores is varied;

a sump having the wick as its inner wall surface and connected to a liquid pipe for supplying a liquid-phase working fluid; and a vapor channel for guiding a gas-phase working fluid into a vapor pipe connected to an end portion of the container.

In addition, the evaporator in accordance with the present invention has a seal member for separating the gas-phase working fluid in the vapor channel or in the vapor pipe and the liquid-phase working fluid in the liquid pipe or the sump and for sealing the sump.

In addition, the evaporator in accordance with the present invention is provided with one wick portion which is formed such that its pore diameter or porosity changes continuously in correspondence with the depth from one surface of the wick.

In addition, in the evaporator in accordance with the present invention, the wick has at least two wick portions having different pore diameters, and at least one wick portion thereof is formed of a nonelastic material.

In addition, in the evaporator in accordance with the present invention, the wick has at least two wick portions having different porosities, and at least one wick portion thereof is formed of a nonelastic material.

In addition, in the evaporator in accordance with the present invention, the wick is formed by laminating at least two kinds of wick portions.

In addition, in the evaporator in accordance with the present invention, the wick portion in a layer facing an inner side of the sump has a larger pore diameter than the wick portion or portions in a remaining layer or layers.

In addition, in the evaporator in accordance with the present invention, the wick portion provided in such a manner as to closely contact the groove ridges formed on the container is formed of a porous material having a pore diameter of 0.1 to 10 $\mu$m.

In addition, in the evaporator in accordance with the present invention, the wick portion in a layer facing an inner side of the sump has a larger porosity than the wick portion or portions in a remaining layer or layers.

In addition, the evaporator in accordance with the present invention comprises a first wick portion provided in such a manner as to closely contact grooves ridges formed on an inner surface of a container and a second wick portion having one end immersed in a liquid-phase working fluid inside a sump and another end provided in such a manner as to closely contact the first wick.

In addition, in the evaporator in accordance with the present invention, the second wick portion has a larger pore diameter than the first wick portion.

In addition, the evaporator in accordance with the present invention, the second wick portion has a larger porosity than the first wick portion.

In addition, in the evaporator in accordance with the present invention, fine grooves for guiding into a vapor channel a gas-phase working fluid produced in a wick contacting the groove ridges formed on an inner wall surface of the container are provided in a portion of contact between the wick and the groove ridges.

In addition, in the evaporator in accordance with the present invention, fine grooves are provided in the wick contacting the groove ridges formed on the inner wall surface of the container.

In addition, in the evaporator in accordance with the present invention, a metal-film forming porous layer having a large thermal conductivity is provided on a surface of contact between the groove ridges formed on the inner wall surface of the container and the wick provided in such a manner as to closely contact the groove ridges.

In addition, in the evaporator in accordance with the present invention, the metal-film forming porous layer is provided on the wick contacting the groove ridges formed on the inner wall surface of the container.

In addition, in the evaporator in accordance with the present invention, a liquid channel for guiding the liquid-phase working fluid recirculated from the condenser into the evaporator through the liquid pipe is provided in the wick or in such a manner as to contact the surface of the wick.

In addition, in the evaporator in accordance with the present invention, the wick is provided which is formed by rolling a flat wick into a hollow cylindrical shape and joining both ends thereof.

In addition, the evaporator in accordance with the present invention further comprises a seal member for separating the liquid-phase working fluid and the gas-phase working fluid by using the elasticity of the wick.

In addition, the evaporator in accordance with the present invention further comprises a liquid reservoir for accumulating the liquid-phase working fluid and provided by sharing both the sump and the wick, a heat insulating material being provided in the liquid reservoir for preventing the evaporation of the liquid-phase working fluid.

In addition, in the evaporator in accordance with the present invention, the container is formed in the shape of a flat plate, and the wick is provided in such a manner as to closely contact the groove ridges formed on the inner surface of the container, and a connecting wick for connecting wick portions is provided in the sump inside the wick.

In addition, in the evaporator in accordance with the present invention, the container is formed by a first side plate and a second side plate disposed in face-to-face relation to each other and having groove ridges on inner wall surfaces thereof as well as a side wall formed in a hollow cylindrical shape, and the wick is formed in such a manner as to closely contact the groove ridges on the first and second side plates through an urging means.

In addition, a loop-type heat pipe in accordance with the present invention comprises: the above-described evaporator, a vapor pipe for guiding a gas-phase working fluid from the evaporator, a condenser connected to the vapor pipe, and a liquid pipe for recirculating a liquid-phase working fluid from the condenser.

The present disclosure relates to the subject matter contained in Japanese patent application No. Hei. 09-053169 (filed on Mar. 7, 1997) which is expressly incorporated herein by reference in its entirely.

BRIEF DESCRIPTION OF THE DRAWINGS

FIG. 13B is a cross-sectional view in which FIG. 13A is rotated by 90 degrees;

DETAILED DESCRIPTION OF THE PREFERRED EMBODIMENTS

First Embodiment

Figure 1:
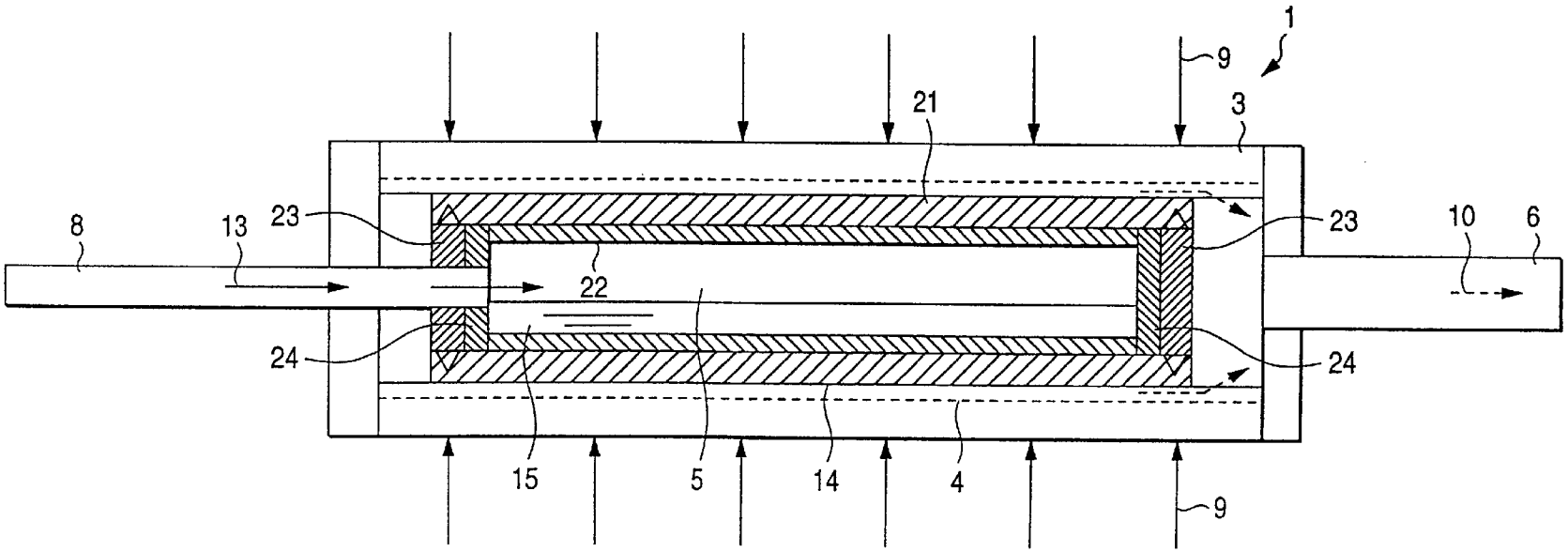
FIG. 1 is an axial cross-sectional view illustrating an evaporator in accordance with a first embodiment of the present invention.
Figure 2:
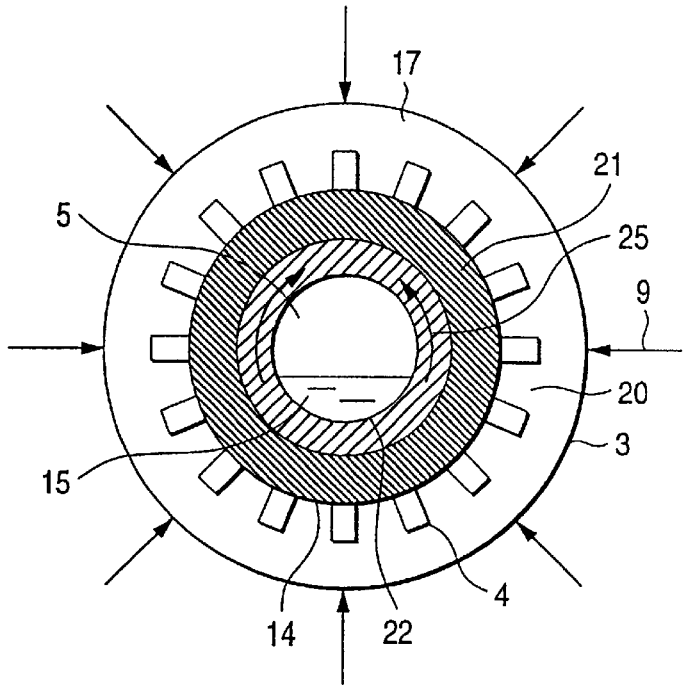
FIG. 2 is a radial cross-sectional view illustrating the evaporator in accordance with the first embodiment of the present invention.
Figure 3:
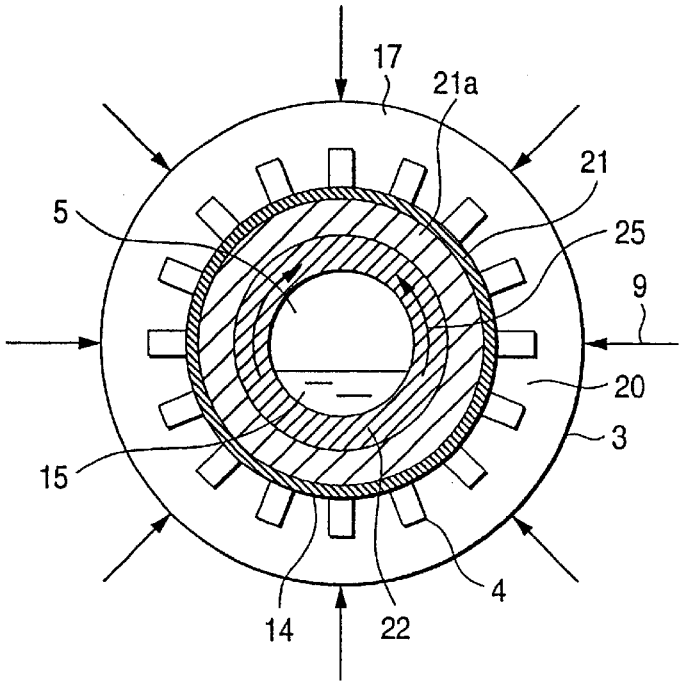
FIG. 3 is a radial cross-sectional view illustrating the evaporator in accordance with the first embodiment of the present invention.
Figure 4:
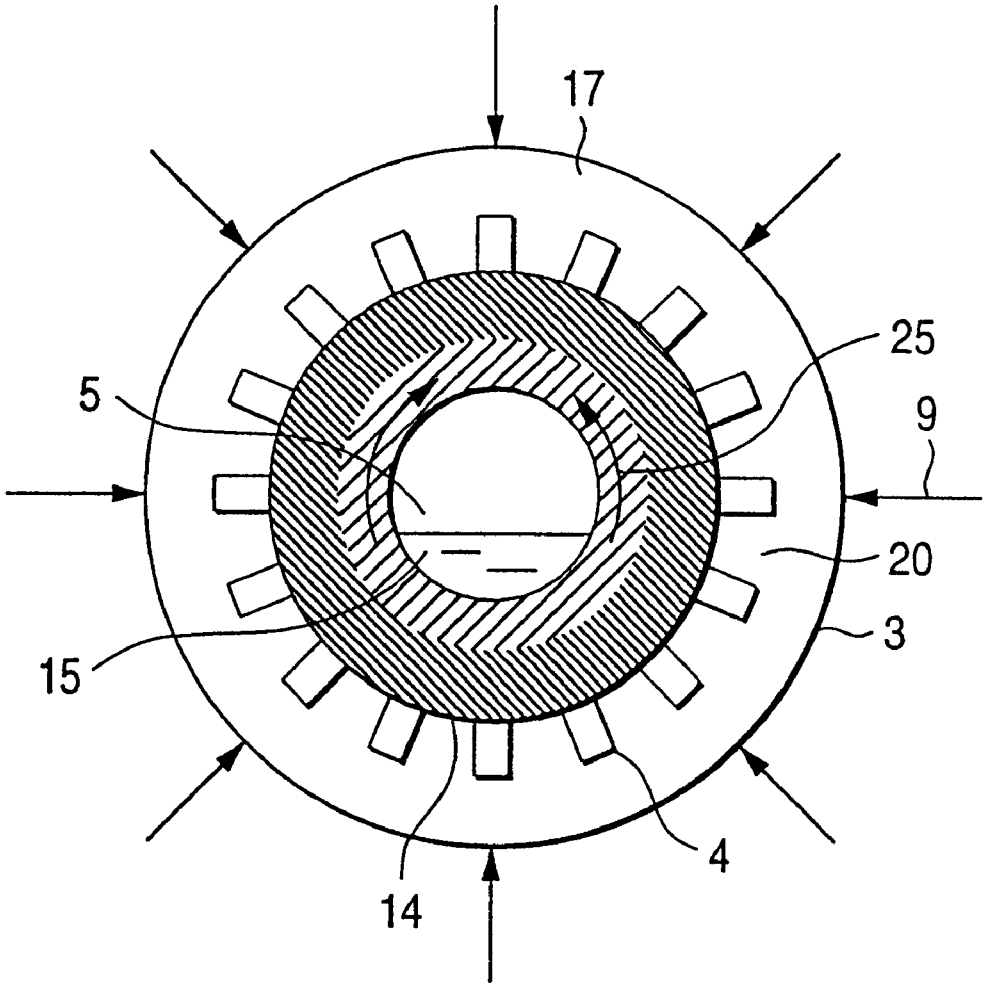
FIG. 4 is a radial cross-sectional view illustrating the evaporator in accordance with the first embodiment of the present invention.

FIG. 1 is an axial cross-sectional view illustrating an evaporator 1 of a loop-type heat pipe in accordance with a first embodiment of the present invention, and FIGS. 2 to 4 are radial cross-sectional views of the evaporator. Reference numerals 1 to 20 denote component elements which are identical to those of the above-described conventional loop-type heat pipe with the exception of a wick 2. Reference numeral 21 denotes an outer surface portion of the wick which is provided in such manner as to closely contact grooved ridges 20 provided on an inner wall surface of an evaporator container 3. The outer surface portion 21 of the wick is formed of porous expanded polytetrafluoroethylene (EPTFE) which is a porous substance having a pore diameter of 0.1 to 10 $\mu$m and which does not chemically react with working fluids such as ammonia and alcohol.

Reference numeral 22 denotes an inner surface portion of the wick, and is formed of a porous ceramic which has a large pore diameter and is a nonelastic material. Numeral 23 denotes a wick seal member having a projection for sealing a sump 5 and vapor channels 4 by making use of the elasticity of the porous expanded polytetrafluoroethylene (EPTFE) which is the material of the outer surface portion 21 of the wick 2. Numeral 24 denotes a heat insulating material formed of such as porous expanded polytetrafluoroethylene which has a small thermal conductivity and does not chemically react with a working fluid 15 such as ammonia and alcohol.

A description will be given of an operating principle of the loop-type heat pipe in accordance with the first embodiment constructed as described above. As shown by the arrow 9 indicating the flow of heat, the heat applied to the evaporator container 3 is transmitted to the liquid-phase working fluid permeating the wick 2 in portions of contact 14 between the outer surface portion 21 of the wick 2 and the groove ridges 20 of the evaporator container 3, and causes the liquid-phase working fluid to evaporate. The liquid-phase working fluid undergoes a phase change into a gas-phase working fluid by evaporating, and this gas-phase working fluid 10 flows into a condenser 7 where it condenses and radiates heat. The liquid-phase working fluid 15 which has undergone the phase change after condensation of the gas-phase working fluid 10 passes through a liquid pipe 8, and is recirculated into the evaporator 1, in the same way as the conventional example.

The liquid-phase working fluid 15 which is returned to the evaporator 1 is accumulated in the sump 5. As shown at 25 in FIG. 2, the liquid-phase working fluid 15 accumulated in the bottom portion of the sump 5 circumferentially permeates the inner surface portion 22 of the wick 2 formed of a material having a large pore diameter, and subsequently permeates the wick outer surface portion 21. The liquid-phase working fluid 15 which 5 permeated the wick outer surface portion 21 is conveyed to the portions of contact 14 between the wick outer surface portion 21 and the groove ridges 20 of the evaporator container 3 by the capillary action of the wick outer surface portion 21, absorbs heat, and evaporates. As the above-described cycle is repeated, the heat is conveyed from the evaporator 1 to the condenser 7.

In this embodiment, unlike the conventional example, the liquid-phase working fluid 15 accumulated in the bottom portion of the sump 5 circumferentially permeates the inner surface portion 22 of the wick 2 which is formed of a material having a larger pore diameter than the outer surface portion 21 of the wick 2 as shown by the arrow 25, and subsequently permeates the outer surface portion 21 of the wick 2. By making the pore diameters nonuniform, the pressure loss caused by the flow in the wick 2 can be reduced, and it becomes possible to allow the liquid-phase working fluid 15 to uniformly permeate the overall wick. For this reason, the heat conveying capacity increases, and reliability can be enhanced.

In a wick which is formed such that, as shown in FIG. 3, three wick portions formed of different porosities, including the wick outer surface portion 21, the wick inner surface portion 22, and a wick intermediate portion 21*a,* which is interposed between these two wick portions and having a pore diameter intermediate those of these portions, are laminated, or in a wick in which, as shown in FIG. 4, the pore diameter are varied continuously in one wick 2, insofar as the pore diameter of the portion corresponding to the wick outer portion 21 is smaller than the pore diameter of the portion corresponding to the wick inner portion 22, it is possible to obtain the advantage of making it possible to alleviate the pressure loss in both of these wicks.

In addition, a force which compresses the wick 2 is constantly applied between the outer surface and inner surface of the wick 2 owing to the capillary pressure difference $\Delta Pc$ due to the wick 2, which serves as the driving force for liquid circulation. In the loop-type heat pipe of this embodiment, however, since the inner surface portion 22 of the wick 2 is formed of the porous ceramic which is a nonelastic material, it is possible to obtain sufficient rigidity, so that the wick inner surface portion 22 is not depressed inwardly. Consequently, an advantage is obtained in that contact at the portions of contact 14 between the wick outer surface portion 21 and the ridges 20 becomes stable, and heat exchange is effected smoothly at the portions of contact 14.

The sump 5 and the vapor channels 4 are sealed by the wick seal member 23 having a projection by making use of the elasticity of the porous expanded polytetrafluoroethylene (EPTFE) which is the member of the outer surface portion 21 of the wick 2. Accordingly, it is possible to prevent the gas-phase working fluid 10, which was produced in the portions of contact 14 between the wick outer surface portion 21 and the groove ridges 20 of the evaporator container 3, from flowing backward into the sump 5, thereby making it possible to prevent a rise in the pressure within the sump 5. Thus, the problem that the operation of the heat pipe stops due to the pressure rise in the sump can be overcome by completely sealing the sump by using the wick seal member.

In addition, the problem that the operation of the loop-type heat pipe is stopped since the heat applied to the evaporator container evaporates the liquid-phase working fluid 15 in the sump 5 and increases the pressure within the sump 5 can be overcome by providing the sump 5 with the heat insulating material 24 formed of such as porous expanded polytetrafluoroethylene which has a small thermal conductivity and does not chemically react with the liquid-phase working fluid such as ammonia and alcohol. Similarly, if a porous resin formed of polyethelene having a smaller thermal conductivity than the wick outer surface portion 21 is used for the wick inner surface portion 22, the amount of heat which flows into the sump 5 through the wick becomes small, and a similar advantage can be obtained.

In addition, since the wick 2 is formed of porous expanded polytetrafluoroethylene (EPTFE) which does not chemically react with the liquid-phase working fluid such as ammonia and alcohol and which is a porous material having a pore diameter of 0.1 to 10 $\mu$m, it is possible to obtain a large capillary pressure difference $\Delta Pc$ and increase the heat conveying capacity. As the material for forming the wick 2, if a porous material which does not chemically react with the liquid-phase working fluid 15 and has a pore diameter of 0.1 to 10 mm, it is possible to obtain an advantage similar to the case in which porous expanded polytetrafluoroethylene (EPTFE) is used.

Second Embodiment

Figure 5:
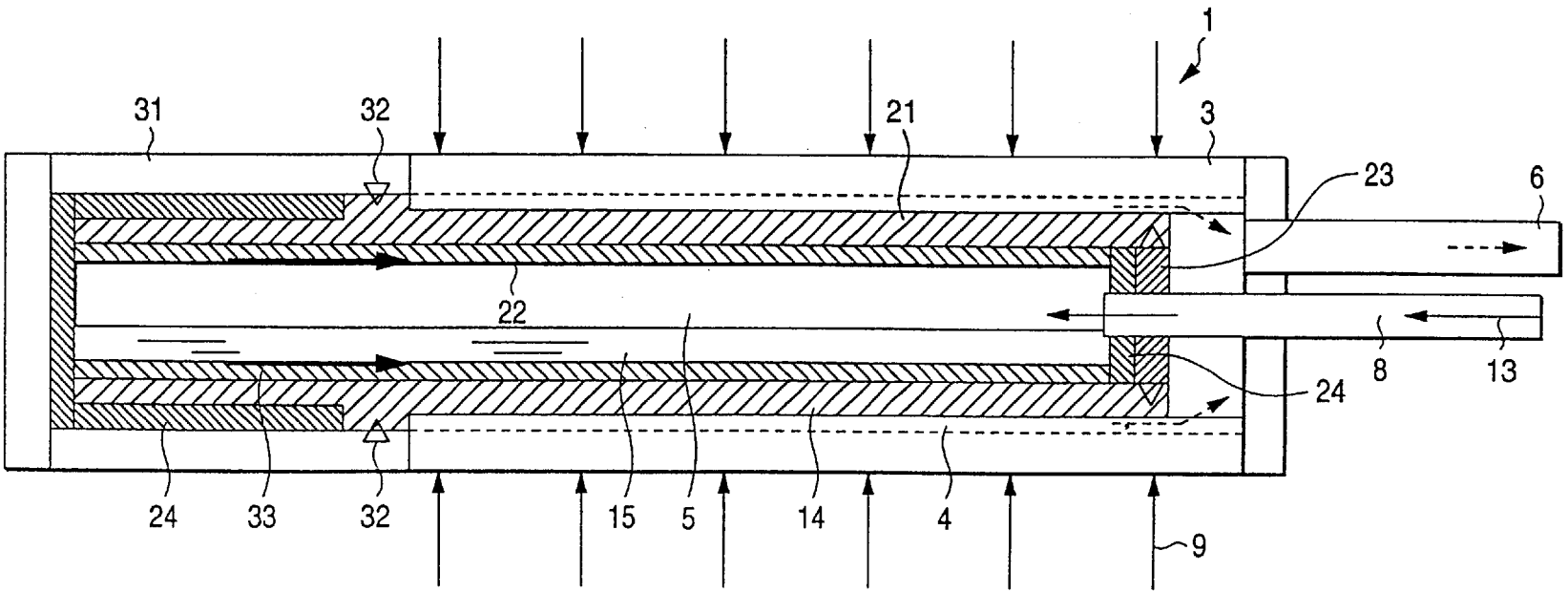
FIG. 5 is an axial cross-sectional view illustrating an evaporator in accordance with a second embodiment of the present invention.

FIG. 5 is an axial cross-sectional view illustrating the evaporator 1 of the loop-type heat pipe in accordance with a second embodiment of the present invention. Reference numerals 1 to 20 denote component elements which are identical to those of the above-described conventional loop-type heat pipe with the exception of the wick 2. Reference numerals 21 to 25 denote component elements which are identical to those of the above-described first embodiment. In the second embodiment, the evaporator 1 has a liquid reservoir 31 which is provided adjacent to the sump 5 and whose interior is a hollow container. The wick 2 provided inside the sump 5 extends into the liquid reservoir 31, and the liquid reservoir is provided with the heat insulating material 24 in such a manner as to cover the outer side of the wick 2. The sump 5 and the liquid reservoir 31 are sealed by a sealing projection 32 at a connecting portion between the evaporator 1 and the liquid reservoir 31, so as to prevent the gas-phase working fluid 10 from entering the interior of the sump.

Since the operating principle of conveying heat from the evaporator 1 to the condenser 7 is similar to that of the loop-type heat pipe of the second embodiment and the loop-type heat pipe of the first embodiment, a description thereof will be omitted. The liquid-phase working fluid 15 which returned from the condenser 7 to the evaporator 1 is accumulated in the sump 5 and the liquid reservoir 31. As shown by arrow 33 in FIG. 3, the liquid-phase working fluid 15 accumulated in the liquid reservoir 31 flows in the axial direction in the wick 2 and recirculates into the sump 5 in the evaporator 1. The operation in which the liquid-phase working fluid subsequently permeates the wick 2 from the sump 5 is similar to that of the first embodiment. It should be noted that since the heat insulating material provided on the outer side of the wick 2 suppresses the evaporation of the liquid-phase working fluid 15 inside the liquid reservoir, it is possible to prevent a rise in the pressure within the liquid reservoir and the sump. Accordingly, a fixed amount of liquid-phase working fluid is constantly secured in the sump and the liquid reservoir.

A necessary predetermined amount of liquid-phase working fluid can be stored in the liquid reservoir 31 irrespective of the inside diameter of the sump 5 by virtue of the action of accumulating the liquid in the liquid reservoir 31 and the action of the wick 2 in conveying the liquid-phase working fluid from the liquid reservoir 31 to the sump 5. The.wick 2 is formed such that the wick inner surface portion 22 formed of a nonelastic material having a large pore diameter and the wick outer surface portion 21 formed of a nonelastic material having a smaller pore diameter than the wick inner surface portion 22 are laminated. The liquid reservoir 31 shares this wick 2 together with the sump 5. However, if the wick provided in the liquid reservoir 31 is provided only at the wick inner surface portion 22 having a larger pore diameter, it is possible to obtain an advantage similar to that of the liquid reservoir provided with the wick 2.

In addition, the outer surface portion 21 of the wick 2 which is located in the vicinity of a joining point between the evaporator 1 and the liquid reservoir 31 is sealed by the sealing projection 32. Accordingly, the vapor 10 which evaporated at the portions of contact 14 between the wick outer surface portion 21 and the groove ridges 20 formed on the inner surface of the evaporator container 3 can be prevented from flowing backward from the vapor channels 4 into the liquid reservoir 31, thereby making it possible to suppress a rise in the pressure within the sump 5. For this reason, it is possible to overcome the problem that the working fluid 15 condensed in the condenser 7 fails to pass from the condenser 7 through the liquid pipe 8 and recirculate into the sump 5 and the operation stops.

Third Embodiment

Figure 6A:
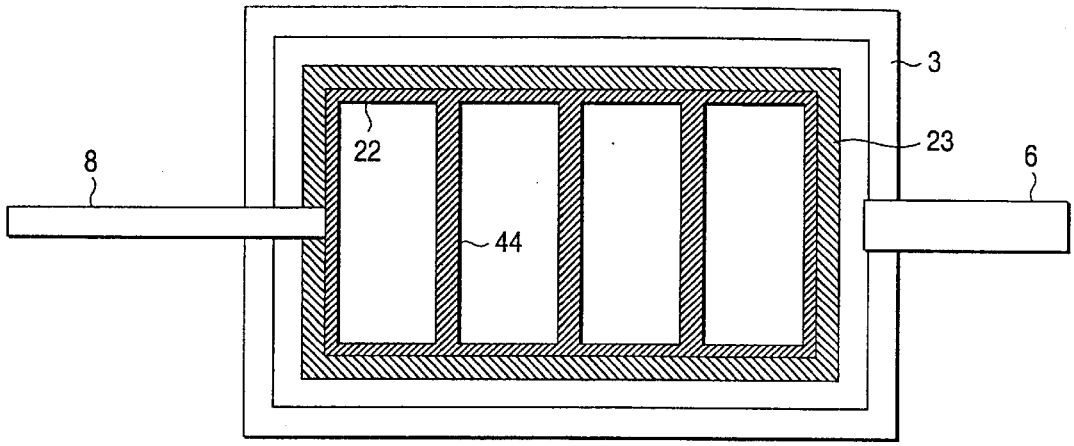
FIG. 6A is a sectional plan view illustrating the evaporator in accordance with a third embodiment of the present invention.
Figure 6B:
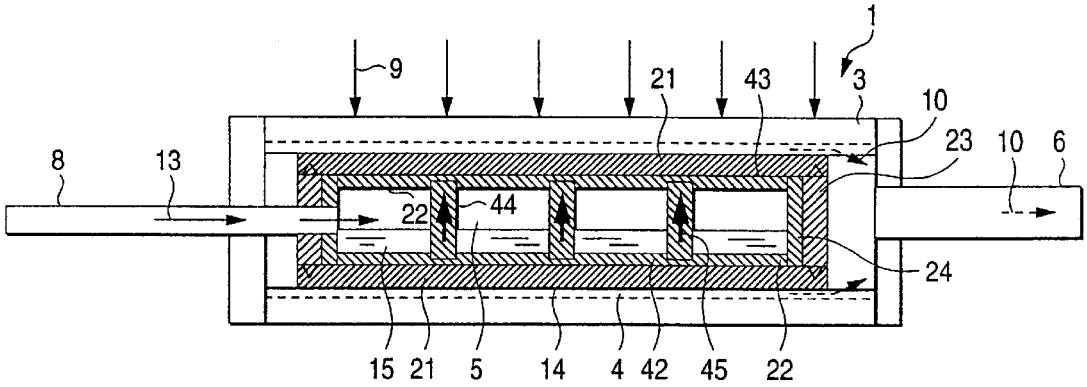
FIG. 6B is a sectional side view illustrating the evaporator shown in FIG. 6A.

FIGS. 6A and 6B are diagrams illustrating the evaporator of the loop-type heat pipe in accordance with a third embodiment of the present invention, in which FIG. 6A is a sectional plan view of the evaporator, and FIG. 6B is a sectional side view of the evaporator. Reference numerals 1 to 20 denote component elements which are identical to those of the above-described conventional loop-type heat pipe with the exception of the wick 2 and the evaporator container 3. Reference numeral 21 denotes the outer surface portion of the wick which is provided in such manner as to contact the ridges 20 formed on the inner wall surface of a rectangular evaporator container 3. The outer surface portion 21 of the wick is formed of porous expanded polytetrafluoroethylene (EPTFE) which is a porous substance having a pore diameter of 0.1 to 10 $\mu$m.

Reference numeral 22 denotes the inner surface portion of the wick, and is formed of a porous ceramic which has a large pore diameter and is a nonelastic material. The inner surface portion 22 of the wick has connecting wick portions 44 which connect a bottom surface portion 42 and an upper surface portion 43. Numeral 23 denotes the wick seal member having a projection for sealing the sump 5 and the vapor channels 4 by making user of the expandability of the porous expanded polytetrafluoroethylene (EPTFE) which is the material of the outer surface portion 21 of the wick. Numeral 24 denotes the heat insulating material formed of such as porous expanded polytetrafluoroethylene which has a small thermal conductivity and does not chemically react with the working fluid 15 such as ammonia and alcohol.

A description will be given of the operating principle of the loop-type heat pipe in accordance with the third embodiment constructed as described above. As shown by the arrow 9 indicating the flow of heat, the heat applied to the evaporator container 3 is transmitted to the liquid-phase working fluid 15 permeating the wick in portions of contact 14 between the groove ridges 20 formed in the evaporator container 3 and the outer surface portion 21 of the wick formed of porous expanded polytetrafluoroethylene at the upper surface and the lower surface of the evaporator container 3, and causes the liquid-phase working fluid 15 to evaporate. The liquid-phase working fluid 15 undergoes a phase change into a gas-phase working fluid by evaporating, and this gas-phase working fluid 10 flows into the condenser 7 where it condenses and radiates heat. The liquid-phase working fluid 15 which has undergone the phase change after condensation of the gas-phase working fluid 10 passes through the liquid pipe 8, and is recirculated into the evaporator 1, in the same way as the conventional example.

The liquid-phase working fluid 15 which returned to the evaporator 1 is accumulated in the sump 5. As shown at 45 in FIG. 6B, the liquid-phase working fluid 15 accumulated in the bottom portion of the sump 5 permeates from the bottom surface portion 42 to the upper surface portion 43 through the connecting wick portions 44 provided at the inner surface portion 22 of the wick, and subsequently permeates the wick outer surface portion 21. The liquid-phase working fluid 15 which permeated the wick outer surface portion 21 is conveyed to the portions of contact 14 between the ridges 20 provided in the evaporator container 3 and the wick outer surface portion 21 by the capillary action, and is then heated again and evaporates. As the above-described cycle is repeated, the heat is conveyed from the evaporator 1 to the condenser 7.

In this embodiment, since the evaporator container 3 is formed in the rectangular shape, the surface where heat is applied is heated in a concentrated manner. For this reason, the evaporation of the liquid-phase working fluid 15 from the wick outer surface portion 21 provided on the surface where heat is not applied is suppressed. In other words, it is possible to obtain an advantage in that the efficiency with which the liquid-phase working fluid 15 permeates the wick outer surface portion 21 provided on the surface where heat is applied can be enhanced, so that the heat conveying capacity increases.

In addition, a force which compresses the wick outer surface portion 21 and the wick inner surface portion 22 is applied between the vapor channels 4 and the sump 5 owing to the capillary pressure difference $\Delta Pc$ which serves as the driving force for circulating the working fluid. In the loop-type heat pipe of this embodiment, however, since the inner surface portion 22 of the wick 2 and the connecting wick portions 44 are formed of the porous ceramic which is a nonelastic material, the wick portions 21 and 22 obtain rigidity sufficient to withstand the force $\Delta Pc$ for compressing the wick. Consequently, an advantage is obtained in that contact at the portions of contact 14 between the wick outer surface portion 21 and the ridges 20 becomes stable, and heat exchange is effected smoothly at the portions of contact 14.

In addition, since the sump 5 and the vapor channels 4 are sealed by the wick seal member 23 having a projection, it is possible to overcome the problem that the gas-phase working fluid 10 which evaporated at the portions of contact 14 between the groove ridges 20 of the evaporator container 3 and the wick outer surface portion 21 flows backward from the vapor channels 4 to the sump 5 and increases the pressure within the sump 5, and the liquid-phase working fluid 15 condensed in the condenser 7 fails to pass from the condenser 7 through the liquid pipe 8 and recirculate into the sump 5, thereby stopping the function of the overall heat pipe.

In addition, since the heat insulating material 24 is provided which is formed of porous expanded polytetrafluoroethylene (EPTFE) which has a small thermal conductivity, does not chemically react with the liquid-phase working fluid 15 such as ammonia and alcohol, and excels in heat insulation, it is possible to prevent the evaporation by the heat applied to the liquid-phase working fluid inside the sump and the evaporator container 3, and it is possible to prevent the problem that the apparatus stops due to a rise in the pressure within the sump 5.

Fourth Embodiment

Figure 7C:
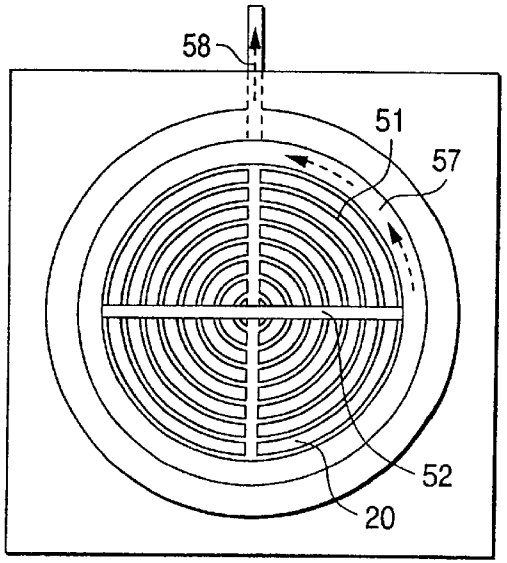
FIG. 7C is an inner surface view illustrating a side plate of the evaporator shown in FIG. 7A.
Figure 7B:
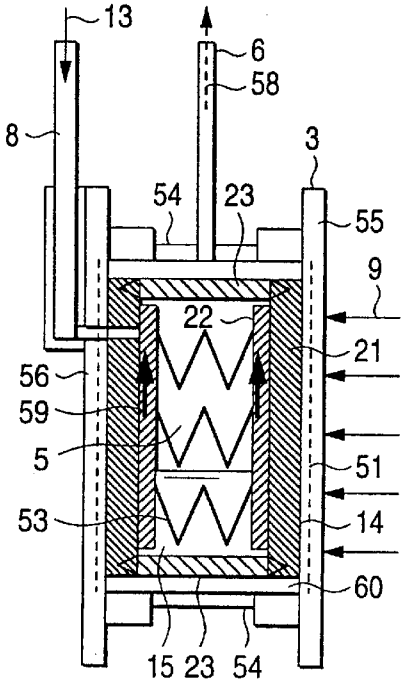
FIG. 7B is a cross-sectional view illustrating the evaporator shown in FIG. 7A.
Figure 7A:
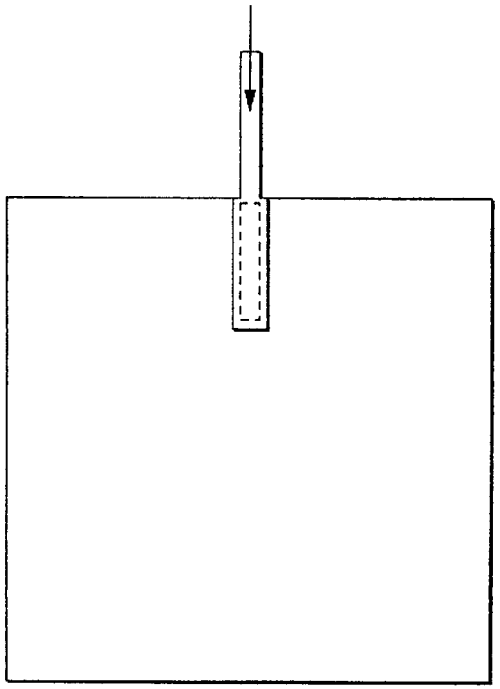
FIG. 7A is a side elevational view illustrating an evaporator in accordance with a fourth embodiment of the present invention.

FIGS. 7A to 7C are diagrams illustrating the loop-type heat pipe in accordance with a fourth embodiment of the present invention, in which FIG. 7A is a side elevational view of the evaporator, FIG. 7B is a front cross-sectional view of the evaporator, and FIG. 7C is an inner surface view illustrating a side plate of the evaporator. Reference numerals 1 to 20 denote component elements which are identical to those of the above-described conventional loop-type heat pipe with the exception of the wick 2. Reference numerals 21 to 23 denote component elements which are identical to those of the first embodiment shown in FIG. 1. The evaporator container 3 has a planar shape similar to that of the third embodiment. This container 3 is comprised of a cylindrical side wall 54 and first and second side walls 55 and 56 which are provided in face-to-face relation to each other, the side plates 55 and 56 being heat transmitting plates which absorb heat and transmit it to the internal wick. The heat transmitting plate provided on the surface where heat is applied is the first side plate 55, while the heat transmitting plate provided on the surface where heat is not applied is the second side plate 56. Grooves 51 are concentrically formed on inner wall surfaces of the first side plate 55 and the second side plate 56, respectively, and the concentric grooves 51 are connected by connecting grooves 52 communicating with the respective grooves, and further communicate with a circumferential groove 57.

Reference numeral 53 denotes a spring for fixing the inner wall surface 22 of the wick inner surface portion 22, and numeral 23 denotes the wick seal member for sealing the sump 5 and the vapor channels 4 by making user of the expandability of the porous expanded polytetrafluoroethylene (EPTFE) 21, and the wick seal member 23 has a hollow cylindrical shape. A vapor space 60 is provided between the wick seal member 23 and the side wall 54. A vapor pipe 6 is provided at the cylindrical side wall 54 and is connected to the vapor space 60. In addition, the liquid pipe 9 communicates with the sump 5 connected to the second side plate 56 facing the first side plate 55 of the evaporator container 3.

A description will be given of the operating principle of the loop-type heat pipe in accordance with the forth embodiment constructed as described above. The evaporator container 3 is disposed vertically such that the vapor pipe 6 is placed on the upper side, and a case is shown in which heat is applied to the first side plate 55 as shown by the arrow 9 indicating the flow of heat. Part of the heat applied to the first side plate 55 flows toward the second side plate provided in face-to-face relation thereto, is transmitted to the liquid-phase working fluid 15 in portions of contact 14 between the concentric grooves 51 of the first side plate 55 and the second side plate 56 and the outer surface portion 21 of the wick formed of porous expanded polytetrafluoroethylene (EPTFE) provided in such a manner as to contact the first side plate 55 and the second side plate 56, and causes the liquid-phase working fluid to evaporate.

A gas-phase working fluid 58 in which the liquid-phase working fluid 15 has undergone a phase change passes through the grooves 51 and the communicating grooves 52, further flows from the circumferential groove 57 to the vapor space 60 and further into the vapor pipe 6, as shown at dotted lines 58 in FIGS. 7B and 7C. The gas-phase working fluid 58 flows from the vapor pipe 6 into the condenser 7 where it condenses, and the condensed liquid-phase working fluid 15 returns to the evaporator 1 through the liquid pipe 8, in the same way as in the conventional example. The liquid-phase working fluid 15 which returned to the evaporator 1 accumulates in the sump 5. As shown by arrow 59 in FIG. 7B, the liquid-phase working fluid 15 which accumulated in the bottom portion of the sump 5 is conveyed to the portions of contact 14 between the wick outer surface portion 21 and the concentric grooves 51 formed in the first side plate 55 and the second side plate 56 by the capillary action of the wick outer surface portion 21, is heated again, and evaporates. As the above-described cycle is repeated, the heat is conveyed from the evaporator 1 to the condenser 7.

In this embodiment, since the evaporator container 3 has a rectangular shape in the same way as in the third embodiment, evaporation from the wick outer surface portion 21 takes place at one rectangular side portion where the area is large. Accordingly, the liquid flow in the wick is not offset as in the case of a cylindrical evaporator, and the liquid-phase working fluid uniformly permeates the overall wick, so that it is possible to obtain the advantage that the pressure loss in the wick can be suppressed, and the heat conveying capacity increases. In addition, since the grooves provided in the first side plate 55 and the second side plate 56 are formed concentrically, and grooves of predetermined sizes can be formed by lathe working, so that there is an advantage in that the fabrication cost can be lowered. It should be noted that, in this embodiment, a similar advantage can be obtained even if the grooves in the first side plate 55 and the second side plate 56 are formed in linear, curved, or checkered shapes.

In addition, since the sump 5 and the vapor channels 4 are sealed by the wick seal member 23 having the projection in the same way as in the third embodiment, the gas-phase working fluid 10 which evaporated at the portions of contact 14 between the concentric grooves 51 formed in the first side plate 55 and the wick outer surface portion 21 can be prevented from flowing backward from the grooves 51, 52 and 57, which can serve as vapor channels, and further from the vapor space 53 into the sump 5, so that the rise in the pressure within the sump 5 can be suppressed. For this reason, it is possible to overcome the drawback that the liquid-phase working fluid 15 which condensed in the condenser 7 fails to pass from the condenser 7 through the liquid pipe 8 and recirculate into the sump 5, stopping the operation.

In addition, the force due to the capillary pressure difference $\Delta Pc$ between the internal sump 5 and the vapor space 60 in the outer peripheral portion of the wick seal member 23 is applied to the wick seal member 23. However, since the wick seal member 23 has a cylindrical shape, the wick seal member 23 does not become deformed, and it is possible to obtain the advantage that the sealing performance is not impaired.

In addition, in the fifth embodiment, since the liquid-phase working fluid 15 in the sump 5 is surrounded by the vapor space 53 filled by the gas-phase working fluid having a small thermal conductivity, and does not come into direct contact with the evaporator container 3. Namely, since conduction of heat from the evaporator container 3 to the sump 5 is cut off, the liquid-phase working fluid 15 in the sump 5 is prevented from being heated and evaporating. Consequently, the rise in the pressure within the sump 5 can be suppressed, and it is possible to prevent the stopping of operation due to the fact that the liquid-phase working fluid 15 condensed in the condenser 7 fails to pass from the condenser 7 through the liquid pipe 8 and recirculate into the sump 5.

In addition, since the side walls are circular in shape, as compared with the rectangular side walls, if the pressure of the internal liquid-phase working fluid is high, the force can be easily withstood, and the reliability improves. Further, since fabrication is easy, an advantage can be obtained in that the fabrication cost can be saved.

Fifth Embodiment

Figure 8:
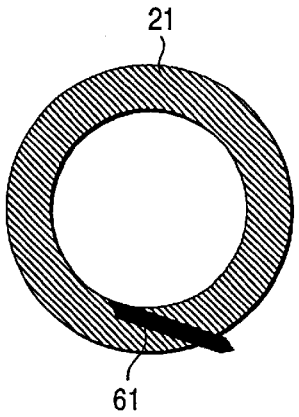
FIG. 8 is a cross-sectional view explaining a method of forming a wick in accordance with a fifth embodiment of the present invention.

FIG. 8 is a cross-sectional view illustrating a method of forming the wick outer surface portion 21 formed of porous expanded polytetrafluoroethylene (EPTFE) which is used in the evaporator container 3 of the loop-type heat pipe in accordance with a fifth embodiment of the present invention. Numeral 21 shown in the drawing denotes the wick outer surface portion joined in a hollow cylindrical shape by rolling a plate wick, and numeral 61 denotes a joined portion thereof.

Normally, in the case of expanded polytetrafluoroethylene (EPTFE), a forming mold is required to directly manufacture a hollow cylinder one. However, there has been a drawback in that the cost of fabricating the mold is high. By rolling a flat wick into a hollow cylindrical shape as shown in this embodiment, an advantage is obtained in that a hollow cylindrical wick can be fabricated at low cost.

Sixth Embodiment

Figure 9:
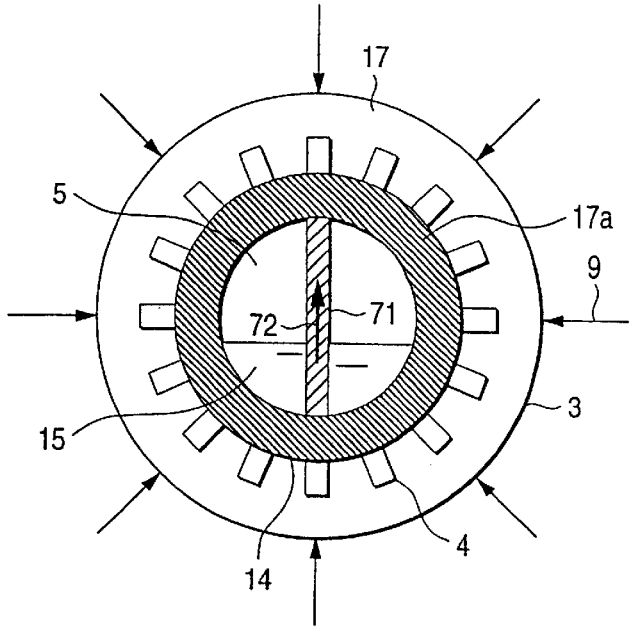
FIG. 9 is a cross-sectional view illustrating an evaporator in accordance with a sixth embodiment of the present invention.

FIG. 9 is a radial cross-sectional view of the evaporator illustrating the loop-type heat pipe in accordance with a sixth embodiment of the present invention. In the drawing, reference numerals 1 to 17 denote component elements which are similar to those of the conventional example. Numeral 71 denotes a second wick having a larger pore diameter than a first wick 71*a,* and the second wick 71 is disposed inside the sump 5 and is formed of a wire net or the like. The second wick 71 has one end fixed to the first wick 71*a* and the other end immersed in the liquid-phase working fluid 15 and fixed to the first wick 71*a*.

In the apparatus of this embodiment, the operation in which heat conveyance is effected from the evaporator 1 to the condenser 7 is similar to that of the first embodiment. In this embodiment, the liquid-phase working fluid 15 accumulated in the bottom portion of the sump 5 upwardly permeates the interior of the second wick 71 having a larger pore diameter than the first wick 71*a* as shown at arrow 72, and subsequently permeates the first wick 71*a*. Accordingly, it is possible to reduce the pressure loss due to the flow in the first wick 71*a,* and the liquid-phase working fluid 15 is easy to permeate an upper portion 17 of the evaporator container 3. For this reason, it is possible to suppress the overheating of the upper portion 17 of the evaporator container 3, so that it is possible to obtain an advantage in that the heat conveying capacity increases and the reliability is increased.

In addition, if the thermal conductivity of the first wick 71*a* is large, heat is conducted to the first wick 71*a* through the portions of contact 14 between the first wick 71*a* and the groove ridges 20 of the evaporator container 3, and the liquid-phase working fluid 15 in the first wick 71*a* is heated and evaporates, and increases the pressure within the sump 5. In this embodiment, however, by the provision of the second wick 71, the low-temperature liquid-phase working fluid 15 accumulated in the bottom portion of the sump 5 recirculated from the condenser 7 passes through the second wick 71 and permeates the first wick 71*a,* as shown by the solid line arrow in the drawing. Accordingly, it is possible to enlarge the surface area for heat exchange between the vapor in the sump 5 and the low-temperature liquid recirculated from the condenser 7, so that heat exchange between the vapor in the sump 5 and the recirculated liquid from the condenser 7 can be facilitated. As a result, it is possible to lower the vapor temperature in the sump 5 and the pressure within the sump 5, so that it is possible to obtain an advantage in that it becomes easy for the liquid-phase working fluid 15 condensed in the condenser 7 to pass through the liquid pipe 8 and recirculate into the sump 5.

In the sixth embodiment, a description has been given of the evaporator which is provided with two wicks, i.e., the first wick 71*a* provided in such a manner as to be brought into close contact with the groove ridges formed on the inner surface of the evaporator container as well as the second wick 71 having one end fixed to the first wick 71*a* and the other end immersed in the liquid-phase working fluid 15 and fixed to the first wick 71*a*. However, the number of the wicks is not be limited to two, and a similar advantage can be obtained if a combination of at least two wicks is used, and the structure provided is such that at least one wick is provided in such a manner as to be brought into close contact with the ridges formed on the inner surface of the evaporator container, and the remaining wicks have one ends fixed to that wick and the other ends immersed in the inner fluid in the liquid phase.

Seventh Embodiment

Figure 10:
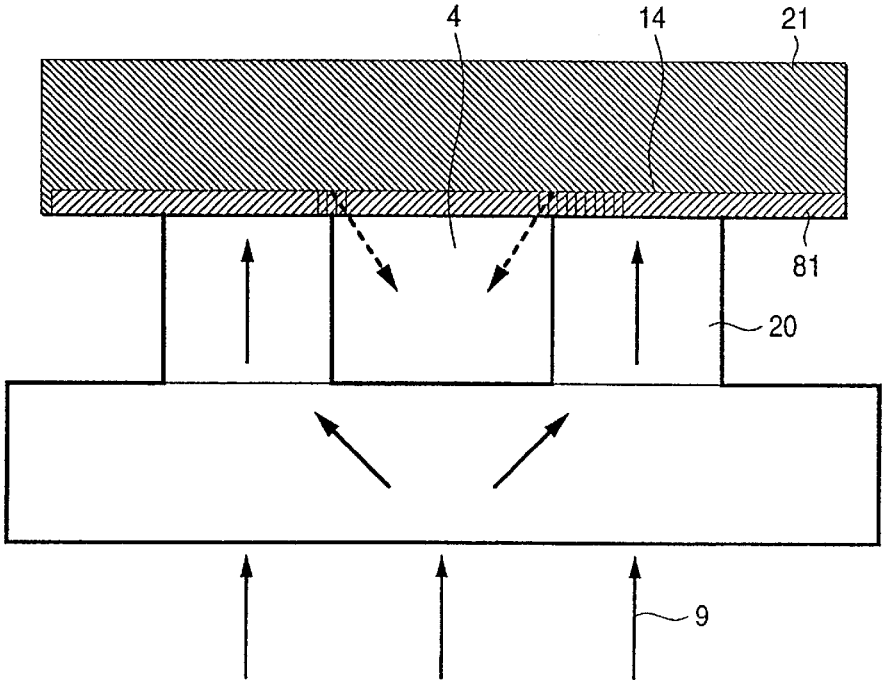
FIG. 10 is an enlarged cross-sectional view illustrating portions of contact of an evaporator with respect to the wick in accordance with a seventh embodiment of the present invention.

FIG. 10 is a cross-sectional view illustrating the structure of the wick 21 used in the evaporator 1 of the loop-type heat pipe in accordance with a seventh embodiment of the present invention. Reference numeral 81 in the drawing denotes a metal-film forming porous layer in which a metal film is provided on the wick 21 formed of porous expanded polytetrafluoroethylene (EPTFE).

As shown at the solid-line arrow 9 in the drawing, the heat which is applied to the evaporator container 3 and transmitted to the wick 21 at the portions of contact 14 between the wick 21 and the ridges 20 provided on the evaporator container 3 uniformly conducts heat to the surface of the wick 21 through the metal-film forming porous layer 81 having a large thermal conductivity. Since the metal-film forming porous layer 81 has a large thermal conductivity, the metal-film forming porous layer 81 efficiently conducts the applied heat to the wick 21. For this reason, even if the temperature difference between the evaporator container 3 and the wick 21 is small, it is possible to allow the liquid-phase working fluid 15 to evaporate.

The metal-film forming porous layer is preferably provided on the wick outer surface portion 21 which comes into contact with the groove ridges 20 formed on the inner surface of the evaporator container. However, if the metal-film forming porous layer is provided on the surface portions of the aforementioned wick outer surface portion 21 contacting the aforementioned ridges 20, it is possible to obtain an advantage similar to the case where the metal-film forming porous layer is provided on the wick outer surface portion 21. In addition, a similar advantage can be obtained if, instead of the metal-film forming porous layer, a porous layer formed of a metal is provided on the wick outer surface portion 21.

Eighth Embodiment

Figure 11:
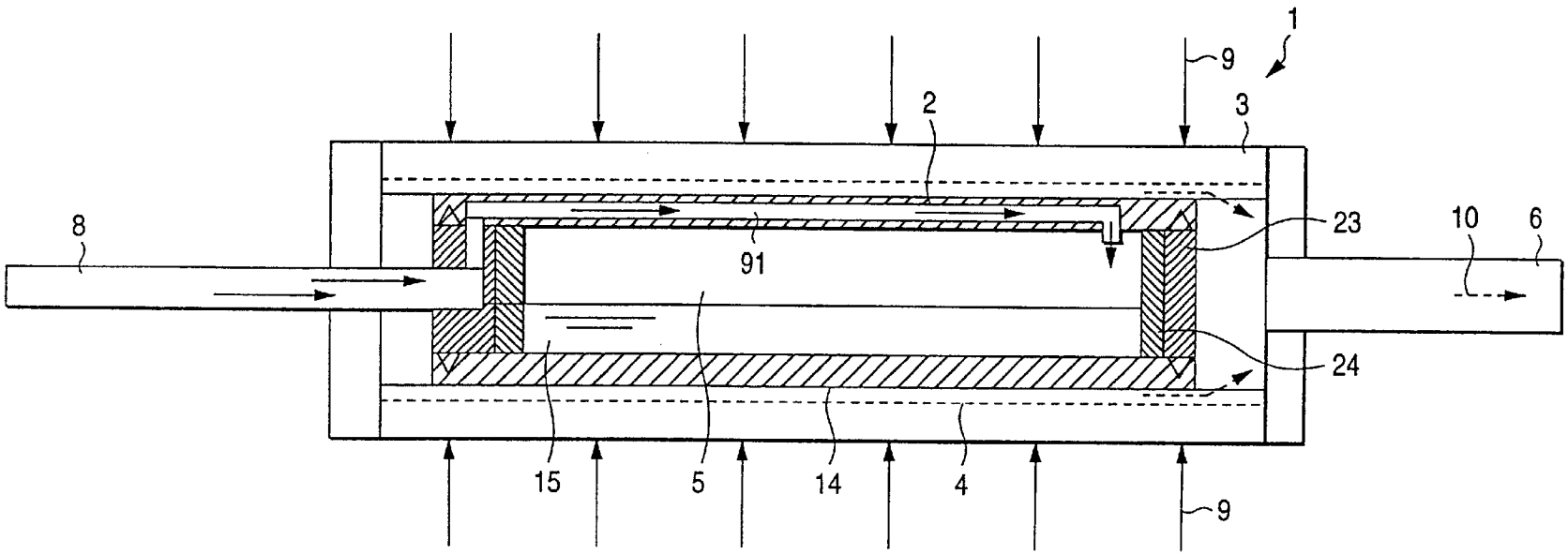
FIG. 11 is an axial cross-sectional view illustrating an evaporator in accordance with an eighth embodiment of the present invention.
Figure 12A:
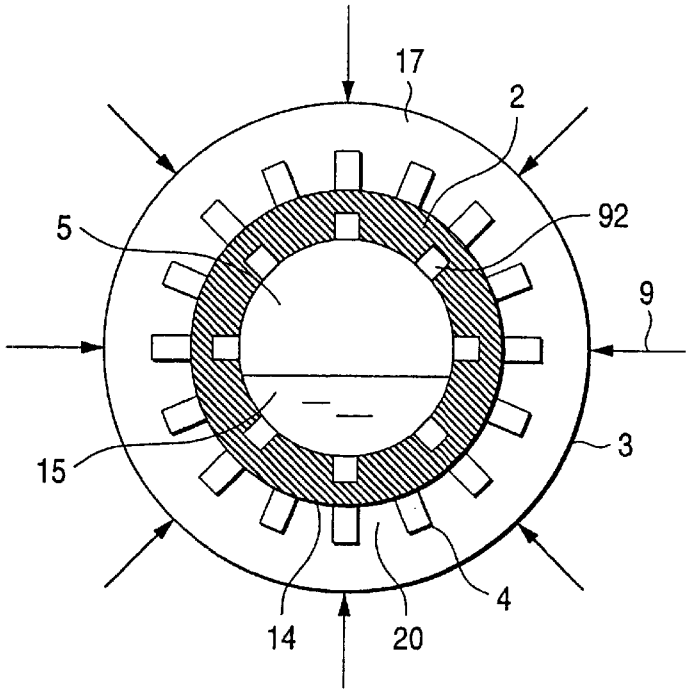
FIG. 12A and FIG. 12B are cross-sectional views illustrating the evaporator in accordance with the eighth embodiment of the present invention.
Figure 12B:
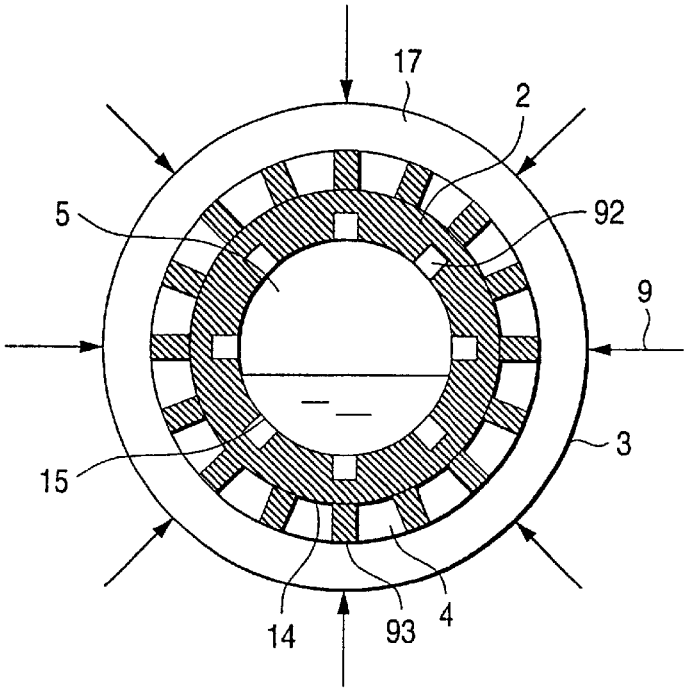

FIG. 11 is an axial cross-sectional view illustrating the evaporator of the loop-type heat pipe in accordance with an eighth embodiment of the present invention, and FIG. 12A and FIG. 12B are a radial cross-sectional view illustrating this evaporator. Reference numerals 1 to 20 denote component elements which are identical to those of the above-described conventional loop-type heat pipe. Reference numerals 23 and 24 denote component elements which are identical to those of the first embodiment. Numeral 91 denotes a liquid channel provided in the wick 2 and having one end communicating with the liquid pipe 8 and the other end communicating with the sump 5.

A description will be given of the operating principle of the loop-type heat pipe in accordance with the eighth embodiment constructed as described above. As shown by the arrow 9, the heat applied to the evaporator container 3 is transmitted to the liquid-phase working fluid 15 at the portions of contact 14 between the wick 2 and the groove ridges 20 provided on the evaporator container 3, and causes the liquid-phase working fluid 15 to evaporate. The gas-phase working fluid 10 flows into the condenser 7, where the gas-phase working fluid undergoes a phase change by condensing and is converted to the liquid-phase working fluid 15, which flows through the liquid pipe 8 and returns to the evaporator 1, in the same way as in the conventional example. After the liquid-phase working fluid 15 which recirculated into the evaporator 1 passes through the liquid channels 91 provided in the wick 2, and is then recirculated into the sump 5.

At this time, part of the liquid-phase working fluid in the liquid channels 91 permeates the wick 2 and therefore permeates the upper portion 17 of the evaporator container 3 as well. Accordingly, it is possible to obtain the advantage that the overheating of the upper portion 17 of the evaporator container 3 can be suppressed and the heat conveying capacity increases. At this time, the liquid channels 91 may not necessarily be located in the wick 2, and a similar advantage can be obtained if the liquid channels are provided in such a manner as to abut against the wick 2 as in the case of grooves 92 provided on the inner wall surface of the wick 2 in FIG. 12A. In addition, a similar advantage can be obtained if the liquid channels are provided in the wick which is formed by laminating two or more wick portions.

Furthermore, although in the above-described embodiments the vapor channels 4 are formed by the ridges 20 provided on the inner wall surface of the container 3, a similar advantage can be obtained if the vapor channels 4 are formed by ridges 93 which are provided on the wick 2 as shown in FIG. 12B.

Ninth Embodiment

Figure 13A:
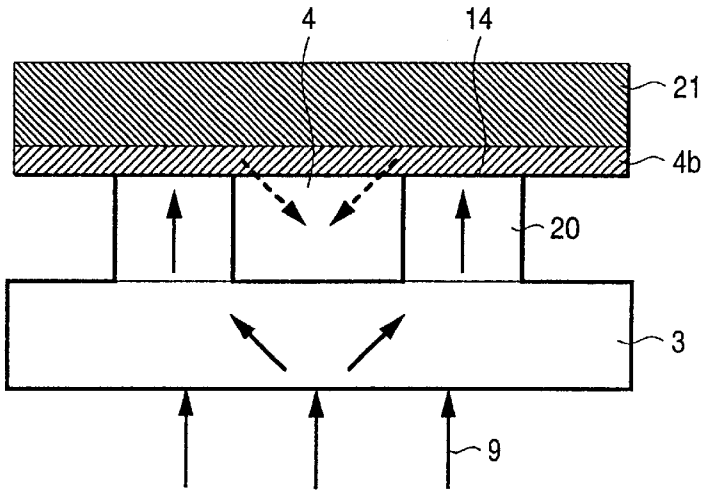
FIG. 13A is an enlarged cross-sectional view illustrating portions of contact of an evaporator with respect to the wick in accordance with a ninth embodiment of the present invention.
Figure 13B:
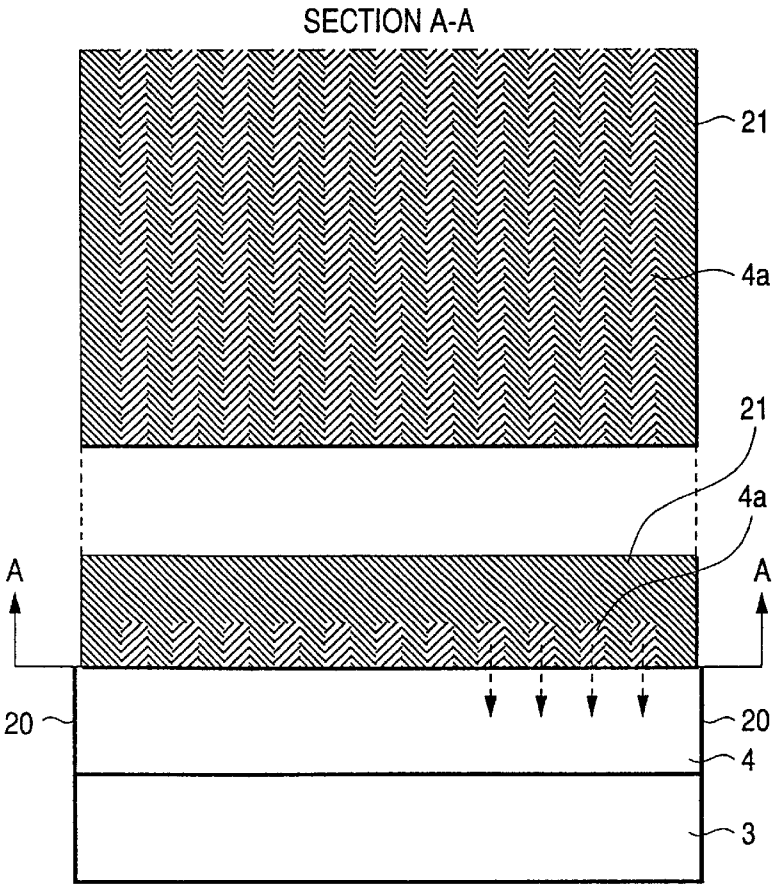
Figure 14:
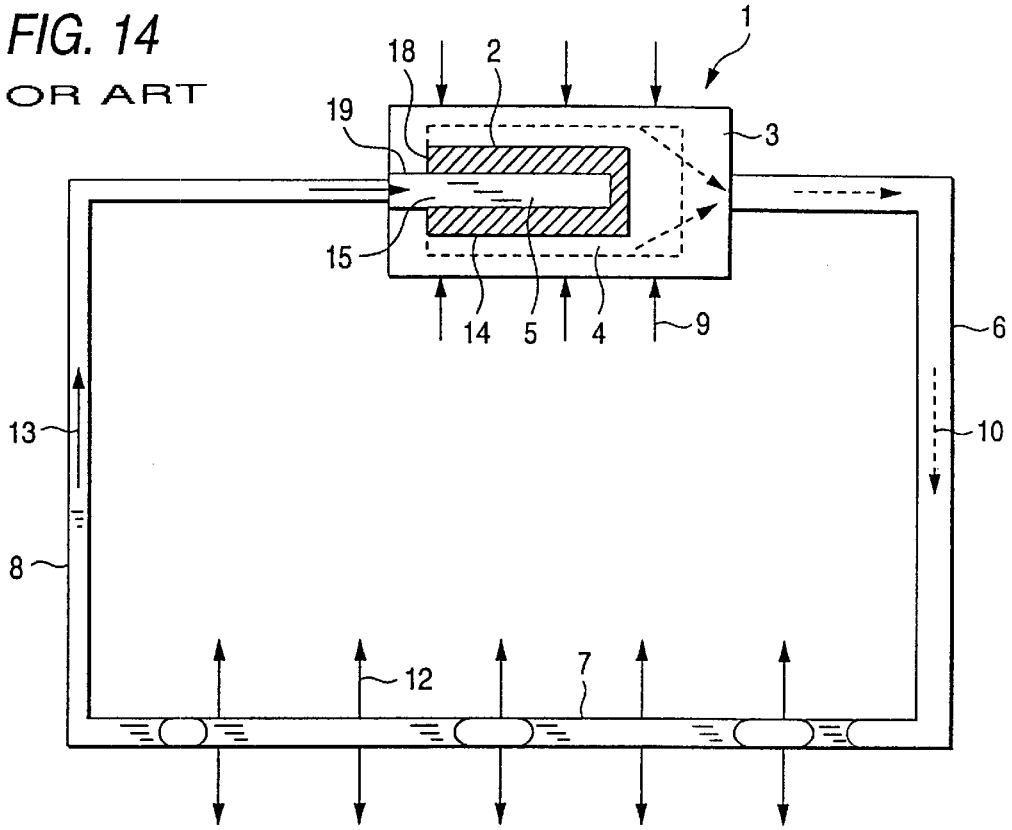
FIG. 14 PRIOR ART
FIG. 14 is an explanatory diagram illustrating a conventional loop-type heat pipe.
Figure 15:
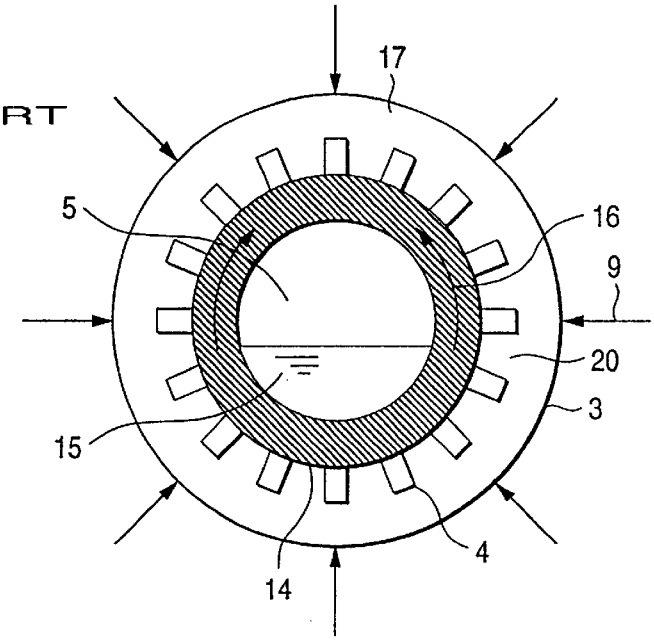
FIG. 15 PRIOR ART
FIG. 15 is a cross-sectional view illustrating a conventional evaporator.

FIG. 13A is an enlarged cross-sectional view of surfaces of contact between the wick 21 and the groove ridges provided on the inner surface of the evaporator container of the loop-type heat pipe in accordance with a ninth embodiment of the present invention. FIG. 13B is a cross-sectional view in which FIG. 13A is rotated by 90 degrees. Reference numeral 3 denotes the evaporator container; 3, a ridge formed on the inner surface of the evaporator container; 21, the outer surface portion of the wick; 4, the vapor channel; 4*a,* a fine 4*b,* a groove ridge of the fine groove; and 9, heat which is applied to the evaporator container.

A description will be given of the operating principle of the loop-type heat pipe in accordance with the ninth embodiment constructed as described above. As shown by the arrow 9, the heat applied to the evaporator container 3 is brought into contact with the liquid-phase working fluid (not shown), which permeated the wick outer surface portion 21, at the ridges 4*b* of the fine grooves provided on the wick outer surface portion 21 in such a manner as to contact the ridges 20, and causes the liquid-phase working fluid to evaporate. The gas-phase working fluid produced at the portions of contact 14 between ridges 4*b* of the fine grooves provided on the wick outer surface portion 21 and the ridges 20 formed on the inner surface of the evaporator container flows into the fine grooves 4*a,* and is then guided to the vapor channels 4. The ridges 4*b* of the fine grooves and the vapor channels 4 contact each other perpendicularly to each other at the portions of contact 14, and the gas-phase working fluid produced at the portions of contact 14 can be released efficiently to the vapor channels 4. Namely, since the heat in the wick can be radiated by efficiently guiding the gas-phase working fluid in the wick to the vapor channels, the heat conveying efficiency can be enhanced, and heat exchange can be allowed to take place effectively even if the temperature difference is small.

It should be noted that, in the ninth embodiment, the fine grooves are provided in the wick outer surface portion 21. However, if the fine grooves are provided in the groove ridges 20 formed on the inner surface of the evaporator container 3, insofar as the fine grooves are so shaped as to allow the vapor channels 4 adjacent to the groove ridges to communicate with each other, the heat in the wick and the evaporator container can be radiated effectively, so that an advantage is offered in that the heat conveying efficiency can be enhanced.

Since the present invention is arranged as described above, the following advantages are offered.

Since the wick of the evaporator used in the loop-type heat pipe in accordance with the present invention is formed such that (1) if the number of pores per unit volume of the wick is fixed, the diameter of pores is varied, or (2) if the diameters of pores of the wick are formed substantially uniformly, the number of pores is varied, it is possible to allow the liquid-phase working fluid to uniformly permeate the wick interior and prevent the local overheating of the wick, thereby making it possible to enhance the efficiency in heat exchange.

In addition, since the evaporator in accordance with the present invention is provided with the seal member for sealing the sump, it is possible to prevent the gas-phase working fluid in the vapor channels and vapor pipe from flowing backward into the sump, raising the pressure within the sump.

In addition, since the evaporator in accordance with the present invention is provided with only one wick portion which is formed such that its pore diameter or porosity changes continuously in correspondence with the depth from one surface of the wick, it is possible to allow the liquid-phase working fluid to uniformly permeate the overall wick even if a plurality of wick portions are not used.

In addition, in the evaporator in accordance with the present invention, the wick has at least two wick portions having different pore diameters, and at least one wick portion thereof is formed of a nonelastic material. Hence, it is possible to obtain necessary rigidity for stably maintaining contact between the groove ridges of the evaporator container and the wick where heat exchange takes place.

In addition, in the evaporator in accordance with the present invention, the wick has at least two wick portions having different porosities, and at least one wick portion thereof is formed of a nonelastic material. Hence, it is possible to obtain necessary rigidity for stably maintaining contact between the groove ridges of the evaporator container and the wick where heat exchange takes place.

In addition, in the evaporator in accordance with the present invention, if the wick is formed by laminating at least two kinds of wick portions having different pore diameters, it is possible to allow the liquid-phase working fluid to uniformly permeate the wick.

In addition, in the evaporator in accordance with the present invention, if the wick is formed by laminating at least two kinds of wick portions having different porosities, it is possible to allow the liquid-phase working fluid to uniformly permeate the wick.

In addition, in the evaporator in accordance with the present invention, the wick is formed by laminating at least two kinds of wick portions having different pore diameters, and the wick portion in a layer facing an inner side of the sump has a larger pore diameter than the wick portion or portions in a remaining layer or layers. Accordingly, it is possible to allow the liquid-phase working fluid to uniformly permeate the wick and prevent the local overheating of the wick, thereby increasing the efficiency in heat exchange.

In addition, in the evaporator in accordance with the present invention, by using a porous material having a pore diameter of 0.1 to 10 $\mu$m as the material of the wick portion, it is possible to increase the capillary pressure difference $\Delta Pc$ serving as the driving force in heat conveyance, and a large heat conveying capacity can be obtained.

In addition, in the evaporator in accordance with the present invention, the wick is formed by laminating at least two kinds of wick portions having different porosities, and the wick portion in a layer facing an inner side of the sump has a larger porosity than the wick portion or portions in a remaining layer or layers. Accordingly, it is possible to allow the liquid-phase working fluid to uniformly permeate the wick and prevent the local overheating of the wick, thereby increasing the efficiency in heat exchange.

In addition, the evaporator in accordance with the present invention comprises a first wick portion provided in such a manner as to closely contact groove ridges formed on the inner surface of the container and a second wick portion having one end immersed in the liquid-phase working fluid inside the sump and another end provided in such a manner as to closely contact the first wick. Accordingly, in the same way as the advantage obtained by laminating at least two wick portions, an advantage can be obtained in that it is possible to allow the liquid-phase working fluid to uniformly permeate the wick and prevent the local overheating of the wick, thereby increasing the efficiency in heat exchange.

In addition, the evaporator in accordance with the present invention comprises a first wick portion provided in such a manner as to closely contact groove ridges formed on the inner surface of the container and a second wick portion having one end immersed in the liquid-phase working fluid inside the sump and another end provided in such a manner as to closely contact the first wick, the pore diameter of the second wick portion being made larger than the pore diameter of the first wick portion. Accordingly, the second wick portion allows the liquid-phase working fluid to uniformly permeate the first wick portion and makes it possible to prevent the local overheating of the wick, thereby increasing the efficiency in heat exchange.

In addition, the evaporator in accordance with the present invention comprises a first wick portion provided in such a manner as to closely contact groove ridges formed on the inner surface of the container and a second wick portion having one end immersed in the liquid-phase working fluid inside the sump and another end provided in such a manner as to closely contact the first wick, the porosity of the second wick portion being made larger than the porosity of the first wick portion. Accordingly, the second wick portion allows the liquid-phase working fluid to uniformly permeate the first wick portion and makes it possible to prevent the local overheating of the wick, thereby increasing the efficiency in heat exchange.

In addition, in the evaporator in accordance with the present invention, since fine grooves are provided in a surface of contact between the groove ridges formed on the inner surface of the evaporator container and the wick provided in such a manner as to closely contact the groove ridges, it is possible to allow the gas-phase working fluid in the wick to escape from the fine grooves into the vapor channels. Hence, the permeation of the liquid-phase working fluid in the wick becomes smooth, so that the efficiency of heat exchange can be increased.

In addition, in the evaporator in accordance with the present invention, since fine grooves are provided in the wick provided in such a manner as to closely contact the groove ridges formed on the inner surface of the evaporator container, it is possible to allow the gas-phase working fluid in the wick to escape from the fine grooves into the vapor channels. Hence, the permeation of the liquid-phase working fluid in the wick becomes smooth, so that the efficiency of heat exchange can be increased.

In addition, in the evaporator in accordance with the present invention, since a metal-film forming porous layer is provided on a surface of contact between the groove ridges formed on the inner wall surface of the container and the wick provided in such a manner as to closely contact the groove ridges, the heat applied to the evaporator container can be smoothly conducted to the wick, and the temperature difference between the evaporator container and the wick can be made small.

In addition, in the evaporator in accordance with the present invention, since a metal-film forming porous layer is provided on the groove ridges formed on the inner wall surface of the container and on the wick provided in such a manner as to closely contact the groove ridges, the heat applied to the. evaporator container can be smoothly conducted to the wick, and the liquid-phase working fluid in the wick can efficiently undergo a phase change into the gas-phase working fluid. Hence, it is possible to obtain an advantage in that the efficiency of heat exchange is improved.

In addition, in the evaporator in accordance with the present invention, since a liquid channel for guiding the liquid-phase working fluid recirculated from the condenser into the evaporator through the liquid pipe is provided in the wick or in such a manner as to contact the surface of the wick, it is possible to allow the liquid-phase working fluid to uniformly permeate the wick, so that the efficiency in heat conveyance can be improved.

In addition, in the evaporator in accordance with the present invention, the wick is used which is formed by rolling a flat wick into a hollow cylindrical shape and joining both ends thereof, and by using this method of fabrication, it is possible to easily fabricate the hollow cylindrical wick.

In addition, in the evaporator in accordance with the present invention, the sump is sealed by inserting a seal member into the elastic wick, so that it is possible to obtain an advantage in that the rise in pressure within the sump can be prevented.

In addition, the evaporator in accordance with the present invention further comprises a liquid reservoir formed by extending the wick and sharing the liquid-phase working fluid together with the sump, and the liquid reservoir has a heat insulating material for preventing the evaporation of the liquid-phase working fluid therein. Accordingly, a fixed amount of liquid-phase working fluid can be constantly supplied to the sump, thereby making it possible to stabilize the efficiency in heat conveyance.

In addition, the evaporator in accordance with the present invention comprises the container which is formed in the shape of a flat plate, and since the container is formed in the shape of the flat plate, heat is applied from one surface, and heat exchange is effected in a concentrated manner in the wick which is provided on the surface where heat is applied. As the wick is provided in such a manner as to closely contact the groove ridges formed on the inner surface of the container formed in the shape of the flat plate, and a connecting wick having a large pore diameter or porosity and for connecting together wick portions of this wick is provided in the sump, an appropriate amount of liquid-phase working fluid can be constantly made to permeate the wick closely contacting the groove ridges. Hence, it is possible to obtain an advantage in that the heat conveying efficiency of the wick on the surface where heat is applied can be increased.

In addition, in the evaporator in accordance with the present invention, a pair of side plates having groove ridges on their inner wall surfaces are disposed in face-to-face relation to each other, the wick is formed in such a manner as to closely contact the groove ridges on the side plates through an urging means, and the wick is covered by a side wall. As the side plates are formed in the shape of a flat plate, heat exchange is effected in a concentrated manner at the surface where heat is applied, so that the pressure loss in the interior of the wick can be reduced, and the heat conveyance efficiency can be improved. In addition, as the side wall is formed into a hollow cylindrical shape, it is possible to obtain an advantage in that the withstanding force against the rise in the pressure within the sump can be enhanced.

What is claimed is:

1. An evaporator comprising:

a container having an inner surface;

a laminated porous wick including at least first and second laminated wick portions, said wick having a thickness and pores, the pores having diameters that vary with position through the thickness of said wick, wherein said second wick portion is outside said first portion, has an outer surface in contact with said inner surface of said container, and is expanded polytetrafluoroethylene, and said first wick portion has an inner wall surface and is a porous ceramic having a greater rigidity than said second wick portion;

a sump defined by the inner wall surface of said first wick portion, said sump being connected to a liquid pipe for supplying a working fluid in a liquid phase; and a vapor channel disposed between said container and said second wick portion, said vapor channel providing fluid communication between said wick and a vapor pipe, said vapor pipe guiding the working fluid in a gas phase and being connected to an end portion of said container.

2. The evaporator of claim 1, wherein said liquid pipe is connected to one end of said container.

3. The evaporator according to claim 2, wherein said liquid channel contacts the inner wall surface of said first wick portion.

4. The evaporator according to claim 1, further comprising a condenser connected to said vapor pipe, said liquid pipe recirculating the working fluid in the liquid phase from said condenser to said evaporator.

5. The evaporator according to claim 1, wherein said first wick portion has a thermal conductivity smaller than said second wick portion.

6. The evaporator according to claim 1, wherein said second wick portion includes pores with diameters in a range of 0.1 to 10 $\mu$m.

7. The evaporator according to claim 1, further comprising at least one wick seal member sealing said sump relative to said wick and said liquid pipe.

8. The evaporator according to claim 7, further comprising a heat insulating element disposed adjacent said wick seal member and between said wick seal member and said sump, providing thermal insulation between said container and the working fluid within said sump.

9. The evaporator according to claim 8 wherein said heat insulating element is polytetrafluoroethylene.

10. The evaporator according to claim 1 wherein said first wick portion has pores of larger diameter than said second wick portion.

* * * * *